United States Patent [19]

Silverberg

[11] Patent Number: 4,576,461

[45] Date of Patent: Mar. 18, 1986

[54] SHEET HINGE FORMING APPARATUS

[75] Inventor: Morton Silverberg, Rochester, N.Y.

[73] Assignee: Xerox Corporation, Stamford, Conn.

[21] Appl. No.: 585,466

[22] Filed: Mar. 2, 1984

[51] Int. Cl.[4] ..... G03G 21/00

[52] U.S. Cl. ..... 355/3 R; 355/3 SH; 428/153; 428/192; 493/324; 493/424

[58] Field of Search ..... 355/3 R, 3 SH, 14 SH; 428/153, 192; 412/18, 22; 493/320, 324, 396, 403, 424, 425

[56] References Cited

U.S. PATENT DOCUMENTS

| | | | |
|---|---|---|---|
| 2,168,896 | 8/1939 | Asnes | 428/153 X |
| 3,687,539 | 8/1972 | Furuichi | 355/3 X |
| 4,051,285 | 9/1977 | Kramer | 428/192 X |
| 4,134,672 | 1/1979 | Burlew et al. | 355/3 SH X |
| 4,408,861 | 10/1983 | Hukuda et al. | 355/3 SH X |
| 4,522,542 | 6/1985 | Minor | 412/22 X |

*Primary Examiner*—Fred L. Braun

*Attorney, Agent, or Firm*—H. Fleischer; J. E. Beck; R. Zibelli

[57] ABSTRACT

An apparatus in which a hinge is formed in successive sheets to permit the sheets to lay substantially flat after being opened when bound to one another in a booklet. The stiffness of successive advancing sheets in a marginal region along a line substantially parallel to an edge of the sheet is reduced to facilitate bending of the sheet. The line of reduced stiffness for successive sheets is offset from one another so as to enable bending of the sheets therealong permitting the open sheets of a booklet of sheets to lay substantially flat.

10 Claims, 4 Drawing Figures

SHEET HINGE FORMING APPARATUS

This invention relates generally to a printing system, and more particularly concerns an apparatus for forming hinges in sheets to facilitate the bending of the sheets when bound in a booklet to permit successive sheets to lay flat.

Generally, in a printing system, an electrophotographic printing machine forms successive copies of original documents. These copies may then be bound into sets of documents. Generally, the binding prevents the sheets of the booklet from remaining open, i.e. the copy sheets do not lay flat on one another. One type of adhesive binding achieves its results by use of an elastomeric adhesive which attaches the sheet edges to a common flexible spine. However, if the adhesive penetrates between the sheets, a rigid end is formed with handling characteristics similar to those where adhesive is applied on the side marginal region of the sheet or where edge stitching is employed. In the foregoing, the resultant booklet does not readily remain open, nor do the copy sheets lay flat one on top of another. Thus, it would be highly desirable to be able to form a hinge in each copy sheet permitting the copy sheet to bend in opposed directions and to lay flat when in an opened booklet. However, in order to achieve the foregoing, the stiffness of the copy sheet along a line substantially parallel to an edge thereof must be reduced to facilitate the bending of the copy sheet. Not only must the stiffness be reduced to one direction, but it must be reduced in two directions in order to enable the copy sheet to bend in both directions. Furthermore, inasmuch as each copy sheet will bend about a different line in order to take into account the thickness of adjacent sheets, successive lines of reduced stiffness on successive copy sheets must be progressively offset from one another in thick books.

Various approaches have been devised for forming creases in articles or sheet-like material. The following disclosures appear to be relevant:

U.S. Pat. No. 308,624
Patentee: Morgan
Issued: Dec. 2, 1884
U.S. Pat. No. 659,246
Patentee: Mayall
Issued: Oct. 9, 1900
U.S. Pat. No. 758,672
Patentee: Mayall
Issued: May 3, 1904
U.S. Pat. No. 1,196,912
Patentee: Weck
Issued: Sept. 5, 1916
U.S. Pat. No. 3,717,074
Patentee: Rasmussen
Issued: Feb. 20, 1973
U.S. Pat. No. 3,731,600
Patentee: Earp
Issued: May 8, 1973

The relevant portions of the foregoing disclosures may be briefly summarized as follows:

Morgan discloses an apparatus for creasing music sheets which allows the sheets to fold alternately in reverse directions. As shown, the ribs of opposed rollers are V-shaped. The resultant music sheet can fold first in one direction and then in the other.

The Mayall patents describe a machine for creasing cardboard and thick paper. Mayall ('246) shows a creasing machine in which a sheet is passed between two segmental rollers carrying creasing dyes. The rolls can be adjusted longitudinally and transversely between adjacent creases. Mayall ('672) shows meshing gears which do not have to move to turn the shafts of the rolls. Creasing dyes having a central V-shaped projection are arranged midway between two curved depressions.

Weck shows a mechanism capable of quickly scoring a paper along parallel lines spaced apart any desired distance.

Rasmussen discloses a method for producing a deadened crease in paperboard. Meshing female and male creasing rollers are employed.

Earp discloses a scoring arrangement for a rotary converter unit having a scoring plate raised slightly from the circumference of a roll.

U.S. Pat. Nos. 1,302,831; 2,519,355; 4,141,544; 4,417,883; German Pat. No. 546,311 and Japanese Patent 53-24195 all show scoring and creasing mechanisms with a pair of rollers having a tooth meshing with a depression in the other roller.

In accordance with one aspect of the present invention, there is provided an apparatus for forming a hinge in successive sheets to permit the sheets to lay substantially flat when opened after being bound to one another in a booklet. Means are provided for advancing successive sheets in seriatim. Means, operatively associated with the advancing means, reduce the stiffness of successive advancing sheets in a marginal region along a line substantially parallel to an edge of a sheet so as to facilitate bending of the sheets along the line of reduced stiffness. Means secure the sheets to one another along the marginal region with the sheets being arranged to bend along the line of reduced stiffness enabling the secured sheets to open and lay substantially flat.

Pursuant to another aspect of the present invention, there is provided a printing system including means for reproducing information on successive sheets. Means, in communication with the reproducing means, form a hinge in each sheet having the information reproduced thereon. Means, adapted to receive successive sheets from the forming means, bind the sheets to form a booklet with the booklet opening at the hinge formed on each sheet and the sheets laying substantially flat with the booklet being open.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
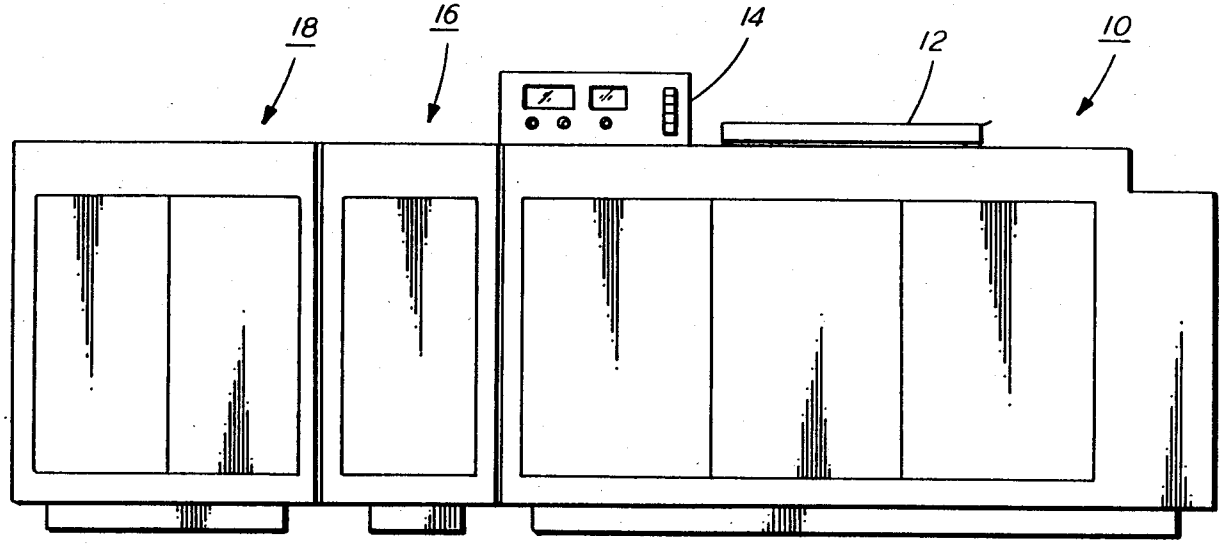
FIG. 1 is a schematic elevational view depicting an illlustrative printing system.

For a general understanding of the features of the present invention, reference is had to the drawings. In the drawings, like reference numerals have been used throughout to designate identical elements. FIG. 1 schematically depicts the printing system comprising an electrophotographic printing machine for reproducing copies, a hinge forming apparatus for producing a hinge in the copy sheet, and a binding apparatus for forming booklets of copy sheets. It will become evident from the following discussion that the hinge forming apparatus is equally well suited for use in a wide variety of printing systems or other types of devices wherein it is desired to readily bend the sheets and have the sheets lay flat with respect to one another. The features of the present invention are not specifically limited in their application to the particular embodiment depicted herein.

Referring now to FIG. 1 of the drawings, the printing system and its operation will be described with reference thereto. Inasmuch as the art of electrophotograhic printing is well known, the printing machine operation will be described briefly. The electrophotographic printing machine, generally designated by the reference numeral 10, is capable of producing a stream of copy sheets having information copied either on one side only, simplex copy sheets, or on both sides, duplex copy sheets. A recirculating document feeder 12 is shown positioned above a platen (not shown) at the imaging station of printing machine 10. Document feeder 12 usually operates in a collating mode in which original documents are fed, in seriatim, from a stack in a tray at the top of the feeder to the platen for copying one at a time for each circulation and then returned to the stack. The original documents are placed in the feeder in a predetermined, page sequential order. For example, the first page is on top of the stack and the last page is at the bottom of the stack. The last original document is fed to the platen first and then returned to the top of the stack. The machine document can control operation of the electrophotographic printing machine and its related apparatus through an operator control panel designated generally by the reference numeral 14. To this end, the machine operator can determine whether a set of copies is to be bound or not.

An illustrative electrophotographic printing machine 10 includes a belt having a photoconductive surface deposited on a conductive substrate. The belt advances successive portions of the photoconductive surface to various processing stations disposed about the path of movement thereof. Initially, a portion of the belt passes through a charging station. At the charging station, a corona generating device charges the photoconductive surface of the belt to a relatively high, substantially uniform potential. Thereafter, the charged portion of the photoconductive surface is advanced through the imaging station. At the imaging station, an original document advanced to the platen is exposed. Lamps flash light rays onto the original document. The light rays reflected from the original document are transmitted through a lens forming a light image thereof. The lens focuses the light image onto the charged portion of the photoconductive surface to selectively dissipate the charge thereon. This records an electrostatic latent image on the photoconductive surface which corresponds to the informational areas contained within the original document disposed upon the platen. Thereafter, the belt advances the electrostatic latent image recorded on the photoconductive surface to a development station. At the development station, a magnetic brush development system transports a developer mixture of carrier granules and toner particles into contact with the electrostatic latent image recorded on the photoconductive surface. The toner particles are attracted from the carrier granules to the electrostatic latent image forming a toner powder image on the photoconductive surface of the belt. After development, the toner powder image is advanced to a transfer station. At the transfer station a copy sheet is moved into contact with the toner powder image. A corona generating device sprays ions onto the back side of the copy sheet to attract the toner powder image thereto. After transfer, the copy sheet advances to a fuser station. At the fuser station, the copy sheet passes between a heated fuser roll and a back-up roll with the toner powder image contacting the heated fuser roll. In this manner, the toner powder image is permanently affixed to the copy sheet. After exiting the fusing station, the copy sheet advances to hinge forming apparatus 16 which reduces the stiffness of the copy sheet in a marginal region along a line substantially parallel to an edge of the copy sheet. When a large number of sheets are to be bound to one another, the line of reduced stiffness for successive copy sheets is progressively offset from one another. In this manner, the copy sheets lay flat when bound in a booklet. Thus, when the booklet is opened, adjacent copy sheets lay flat one on another. The copy sheets bend about their own respective line of reduced stiffness. The progressive offset of successive lines of stiffness for successive copy sheets accounts for the thickness of adjacent sheets. However, when a small number of sheets are to be bound to one another, i.e. a thin booklet rather than a thick booklet, successive sheets need not have the line of reduced stiffness progressively offset. The detailed structure of the hinge forming apparatus will be described hereinafter with reference to FIGS. 2 and 3. After the lines of reduced stiffness have been formed on the copy sheet, i.e. the hinge formed therein, the copy sheet advances to an adhesive binder, indicated generally by the reference numeral 18. A bound booklet is formed by binder 18 from a set of copy sheets fed, in seriatim, from hinge forming apparatus 16. The set of copy sheets may have any particular order or sequence. For example, when recirculating document feeder 14 is operating in its collating mode, the set of copy sheets are fed in the same order as the set of document sheets in the feeder with the first copy sheet of a set delivered to the binder being a copy of the last sheet of the document set and with the last copy sheet of a set delivered to the binder being a copy of the first sheet of the documents fed. An adhesive applicator in binder 18 applies a line of adhesive on the marginal region of the copy sheet. The applicator forms a strip of adhesive on each sheet of the set of copy sheets in the booklet. A pressure bar assembly presses the set of copy sheets together after the last sheet has the adhesive applied thereon. A detailed description of a suitable adhesive binder may be found in Article 22733, entitled "Binding Apparatus and Method", on pages 120 through 129, inclusive, of the March, 1983 Research Disclosure, and Article 22734, entitled "Adhesive Dispensing System", on pages 129 through 134, inclusive, of the March, 1983 Research Disclosure. The relevant portions of the foregoing Articles are hereby incorporated into the present application.

Figure 2:
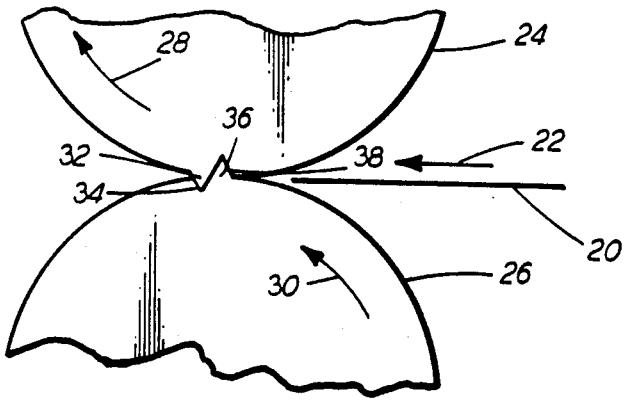
FIG. 2 is a fragmentary elevational view depicting the operation of the hinge forming apparatus used in the FIG. 1 printing system.

Turning now to FIG. 2, there is shown the detailed manner of operation of hinge forming apparatus 16. As shown thereat, the copy sheet, indicated generally by the reference numeral 20, advances, in the direction of arrow 22, into the nip between cylindrical rollers 24 and 26. Cylindrical rollers 24 and 26 rotate in the direction of arrows 28 and 30, respectively. Thus, cylindrical rollers 24 and 26 continue to advance copy sheet 20 in the direction of arrow 22. Cylindrical roller 24 has a protrusion having a triangular cross section extending outwardly from the exterior circumferential surface thereof in a direction substantially parallel to the longitudinal axis thereof across the entire width of roller 24. Protrusion 32 of cylindrical roll 24 meshes with a triangularly shaped groove 34 in cylindrical roll 26. Similarly, cylindrical roll 26 has a protrusion 36, having a triangular cross section extending outwardly from the exterior surface thereof in a direction substantially parallel to the longitudinal axis across the entire width of roller 26. Protrusion 36 of roller 26 meshes with a triangularly shaped groove 38 in cylindrical roll 24. Protrusions 32 and 36 engage a marginal region of copy sheet 20. Thus, initially, the leading edge of copy sheet 20 engages a smooth portion of cylindrical rollers 24 and 26 in the nip region. Thereafter, as rollers 24 and 26 continue to rotate in the direction of arrows 28 and 30, respectively, protrusions 32 and 36 engage the copy sheet bending it in mutually opposed directions. This bending or creasing of the copy sheet in mutually opposed directions significantly reduces the stiffness of the copy sheet. Thus, the reduction of stiffness of the copy sheet along two offset lines permits the copy sheet to bend readily in opposed directions. The detailed manner of bending or creasing the copy sheet in the nip is shown, in greater detail, in FIG. 3. After the copy sheet passes through the nip between rollers 24 and 26, it advances to binder 18. At binder 18, a stack of sheets is bound to one another. A conveyor (not shown), having a gate associated therewith, controls the movement of copy sheet 20 into the nip between rollers 24 and 26. The timing of the advancement of the copy sheet into the nip between rollers 24 and 26 is controlled by logic circuitry. This timing, i.e. the movement of the gate in a downwardly direction to permit the copy sheet to advance along the conveyor into the nip between rollers 24 and 26, controls the point at which the creases in the copy sheet are formed. Thus, depending upon the exact point at which the lead edge of the copy sheet enters the nip between the rollers 24 and 26, i.e. the distance along the circumference of the rollers 24 and 26 which first engage the lead edge of the copy sheet, determines the point at which the creases are to be formed. Logic circuit controls the movement of the gate which regulates the passage of successive copy sheets on the conveyor. In this way, the creases formed in the marginal regions of each copy sheet may be controlled to be offset from one another, or to be coincident with one another.

Figure 3:
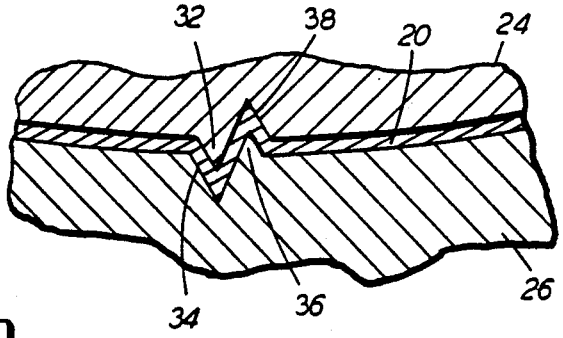
FIG. 3 is a fragmentary, sectional elevational view depicting the detailed manner in which a hinge is formed in a sheet by the FIG. 2 hinge forming apparatus.

Turning now to FIG. 3, there is shown the detailed manner in which the creases or hinges are formed in copy sheet 20. As illustrated thereat, protrusion 36 of cylindrical roll 26 meshes with groove 38 of cylindrical roll 24. Similarly, protrusion 32 of cylindrical roll 24 meshes with groove 34 of cylindrical roll 26. In this way, copy sheet 20 is creased in mutually opposed directions. The creases or hinges permit the copy sheet to bend in both directions, i.e. mutually opposed directions, by reducing the stiffness of the copy sheet along a line substantially parallel to an edge thereof.

Figure 4:
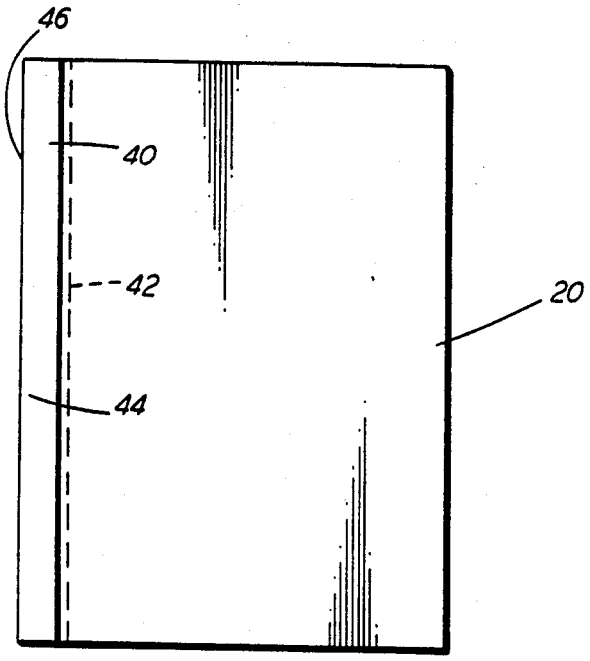
FIG. 4 is a plan view showing a sheet having hinge lines formed on opposed sides thereof by the FIG. 2 hinge forming apparatus.

Referring now to FIG. 4, there is shown copy sheet 20 having hinges or creases formed therein. As depicted thereat, a line of adhesive may be placed on copy sheet 20 in the marginal region, indicated generally by the reference numeral 44. Creases 40 and 42 formed in copy sheet 20 permit copy sheet 20 to readily bend in opposed directions and lay flat. The creases significantly reduce the stiffness of the copy sheet. It should be noted that creases 40 and 42 in copy sheet 20 are formed in the marginal region and spaced from edge 46. Adhesive may be placed in marginal region 44 between crease 40 and edge 46. Creases 40 and 42 are substantially parallel to edge 46. The creases 40 and 42 formed in successive copy sheets 20 may be offset from one another when a large number of sheets are bound together, i.e. for a thick booklet. Thus, the distance between edge 46 and creases 40 and 42 will progressively increase. This enables successive copy sheets to lay flat as the booklet is opened.

In recapitulation, it is clear that the printing system of the present invention includes an electrophotographic printing machine for forming copies of original documents. The copy sheets then advance from the printing machine to a hinge forming apparatus which forms creases or hinges therein permitting the copy sheets to bend readily in opposed directions and lay flat when formed in a booklet. Booklets of copy sheets are formed in an adhesive binder.

It is, therefore, evident that there has been provided in accordance with the present invention an apparatus for forming hinges in successive copy sheets which permit adjacent sheets to lay flat when opened in a bound booklet. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

I claim:

1. An apparatus for forming a hinge in successive sheets to permit the sheets to lay substantially flat when opened after being bound to one another in a booklet, including:

means for advancing successive sheets in seriatim;

means, operatively associated with said advancing means, for reducing the stiffness of successive advancing sheets in a marginal region along a line substantially parallel to an edge of the sheet so as to facilitate bending of the sheets along the line of reduced stiffness, said reducing means forming the line of reduced stiffness in successive sheets progressively offset from one another; and means for securing the sheets to one another along the marginal region with the sheets being arranged to bend along the line of reduced stiffness enabling the secured sheets to be opened and lay substantially flat.

2. An apparatus according to claim 1, wherein said reducing means forms a pair of lines of reduced stiffness on each sheet with the lines of reduced stiffness being substantially parallel to one another and being arranged to facilitate bending of the sheet in opposed directions.

3. An apparatus according to claim 2, wherein said advancing means includes a pair of rollers defining a nip through which each sheet advances.

4. An apparatus according to claim 3, wherein said reducing means includes at least one protrusion extending outwardly from one of said pair of rollers in a direction substantially parallel to the longitudinal axis of said one of said pair of rollers and at least one groove in the other of said pair of rollers arranged to mesh with said protrusion of said one of said pair of rollers.

5. An apparatus according to claim 4, wherein said reducing means includes at least one protrusion extending outwardly from said other of said pair of rollers in a direction substantially parallel to the longitudinal axis of said other of said pair of rollers and at least one groove in said one of said pair of rollers arranged to mesh with said protrusion of said other of said pair of rollers.

6. A printing system, including:

means for reproducing information on successive sheets;

means, in communication with said reproducing means, for forming a hinge in each sheet having information reproduced thereon said hinge forming means including means for advancing successive sheets in seriatim, and means, operatively associated with said advancing means, for reducing the stiffness of successive advancing sheets in a marginal region along a line substantially parallel to an edge of the sheet with the line of reduced stiffness for successive sheets being progressively offset from one another so as to facilitate bending of the sheets along the line of reduced stiffness; and means, adapted to receive successive sheets from said forming means, for binding the sheets to form a booklet with the booklet opening at the hinge formed on each sheet and the sheets laying substantially flat with the booklet being opened.

7. A printing system according to claim 6, wherein said reducing means forms a pair of lines of reduced stiffness on each sheet with the lines of reduced stiffness being substantially parallel to one another and being arranged to facilitate bending of the sheet in opposed directions.

8. A printing system according to claim 7, wherein said advancing means includes a pair of rollers defining a nip through which each sheet advances.

9. A printing system according to claim 8, wherein said reducing means includes at least one protrusion extending outwardly from one of said pair of rollers in a direction substantially parallel to the longitudinal axis of said one of said pair of rollers and at least one groove in the other of said pair of rollers arranged to mesh with said protrusion of said one of said pair of rollers.

10. A printing system according to claim 9, wherein said reducing means includes at least one protrusion extending outwardly from said other of said pair of rollers in a direction substantially parallel to the longitudinal axis of said other of said pair of rollers and at least one groove in said one of said pair of rollers arranged to mesh with said protrusion of said other of said pair of rollers.

* * * * *